US010123597B1

(12) United States Patent
Tong

(10) Patent No.: US 10,123,597 B1
(45) Date of Patent: Nov. 13, 2018

(54) VERTICAL LUGGAGE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 0 days.

(21) Appl. No.: 15/867,726

(22) Filed: Jan. 11, 2018

(51) Int. Cl.

| | |
|---|---|
| ***A45C 5/14*** | (2006.01) |
| ***A45C 5/03*** | (2006.01) |
| ***A45C 13/26*** | (2006.01) |
| ***A45C 13/03*** | (2006.01) |
| ***A45C 13/10*** | (2006.01) |
| *A45C 13/02* | (2006.01) |

(52) U.S. Cl.
CPC ..... *A45C 5/03* (2013.01); *A45C 5/14* (2013.01); *A45C 13/03* (2013.01); *A45C 13/103* (2013.01); *A45C 13/262* (2013.01); *A45C 2005/035* (2013.01); *A45C 2013/026* (2013.01); *A45C 2013/267* (2013.01)

(58) Field of Classification Search
CPC ..... A45C 5/14; A45C 5/03; A45C 3/12
USPC ..... 190/109, 110
See application file for complete search history.

(56) References Cited

U.S. PATENT DOCUMENTS 4,453,623 A * 6/1984 Horii ..... A45C 13/02 190/102
4,854,431 A * 8/1989 Pulichino, Jr. ..... A45C 3/00 190/108
5,474,162 A * 12/1995 Shyr ..... A45C 5/14 190/109
5,575,391 A * 11/1996 Gerch ..... A45C 5/14 190/109
6,900,509 B2 * 5/2005 Gallup ..... G02B 6/4201 257/21
8,453,813 B2 * 6/2013 Lai ..... A45C 13/02 190/109
8,636,123 B2 1/2014 Santy et al.
2004/0007434 A1 * 1/2004 Godshaw ..... A45C 7/0054 190/115
2005/0224305 A1 * 10/2005 Davis ..... A45C 5/14 190/113
2010/0101971 A1 * 4/2010 Chisholm ..... A45C 5/03 206/526
2012/0247898 A1 10/2012 Martucci
2015/0129384 A1 * 5/2015 Mertens ..... A45C 5/14 190/127
2017/0332753 A1 * 11/2017 Lai ..... A45C 5/03
2018/0027939 A1 * 2/2018 Lai ..... A45C 5/03
2018/0140065 A1 * 5/2018 Sheikh ..... A45C 5/03

* cited by examiner

*Primary Examiner* — Sue A Weaver
(74) *Attorney, Agent, or Firm* — Pai Patent & Trademark Law Firm; Chao-Chang David Pai

(57) ABSTRACT

A vertical luggage includes a luggage body having an opening located on a front panel thereof and recessed toward a back panel thereof, a rectangular front bag stitched with one lateral side thereof to one lateral side of the luggage body for use as a front cover to close the opening of the luggage body, a first zipper for binding the other three sides of the front bag to the other three sides of the opening, and a compressible inner bag stitched to an inner side of the front bag for holding a suit bag and other storage items, and a bottom layer space defined in a bottom side inside the luggage body.

9 Claims, 6 Drawing Sheets

VERTICAL LUGGAGE

BACKGROUND OF THE INVENTION

(a) Field of the Invention

The present invention relates to luggage technology and more particularly, to a vertical luggage made of fabric and can be towed while walking and the cover thereof can be opened when it is held in vertical.

(b) Description of the Prior Art

One of the most common luggage configurations today, such as shown in U.S. Pat. No. 8,636,123 and Publication No. US20120247898, is the use of a flexible outer fabric cover with a frame mounted within the flexible outer fabric cover. The frame supports the flexible outer fabric cover in shape, forming a rectangular hollow box body. Further, two or four wheel assemblies are provided at the bottom side of the box body. Further, a rectangular handle is provided at the back panel of the box body so that the user can drag the luggage. Further, front side of the aforesaid luggage design is an opening. Further, a front cover is connected with its one lateral side to one lateral side of the opening of the front side of the luggage so that the front cover can close the opening.

However, since the front side of the aforesaid prior art luggage design is an opening, the luggage must be placed on the floor in horizontal before opening the front cover. Therefore, when the user goes out and wishes to temporarily put personal items in the luggage or to take a storage item out the luggage, it will cause a lot of trouble, for example, unable to find a right place to lay the luggage, or all storage personal items will be exposed to the outside when opens the front cover. Further, the user may need to bring a suit for a business trip or for use in certain situations. However, the aforesaid prior art luggage design must be laid down in horizontal so that the user can put the suit bag in the luggage or take the suit bag out of the luggage, leading to storing and removing inconvenience. Therefore, it is desirable to provide a luggage that eliminates the aforesaid problems.

SUMMARY OF THE INVENTION

The present invention has been accomplished under the circumstances in view. It is one object of the present invention to provide a vertical luggage, which comprises a luggage body having an opening located on a front panel thereof and recessed toward a back panel thereof, a front bag stitched with one lateral side thereof to one lateral side of the opening of the luggage body to work as a cover for covering the opening of the luggage body, a first zipper adapted for binding the other three sides of the front bag to the other three sides of the opening of the luggage body. Due to the configuration of the opening, the luggage body is formed as a rectangular box with a notched structure at the front side. Thus, the user can open the front bag to access to the inside of the luggage body while keeping the vertical luggage in vertical.

According to another aspect of the present invention, the vertical luggage further comprises a compressible inner bag stitched to an inner side of the front bag. When storage items are stored in the inner bag, the inner bag is expanded. On the contrary, when the inner bag is empty, it can be collapsed and flattened.

According to still another aspect of the present invention, an extendable suit bag is stitched to the inner bag for holding a suit. When the suit bag is not in use, it can be folded up and the inner bag can be collapsed and flattened to reduce space occupation.

According to still another aspect of the present invention, multiple mezzanine spaces are defined in the front panel of the front bag and the inner bag for storing small items conveniently while the luggage body standing still.

According to still another aspect of the present invention, a bottom layer space is defined in a bottom side inside the vertical luggage, and a storage box is arranged in the bottom layer space. When the user opens the front bag (cover) from the luggage body as the luggage body stands still, the storage box will not fall out of the luggage body.

Other advantages and features of the present invention will be fully understood by reference to the following specification in junction with the accompanying drawings, in which like reference signs denote like components of structure.

DETAILED DESCRIPTION OF THE PREFERRED EMBODIMENTS

Figure 1:
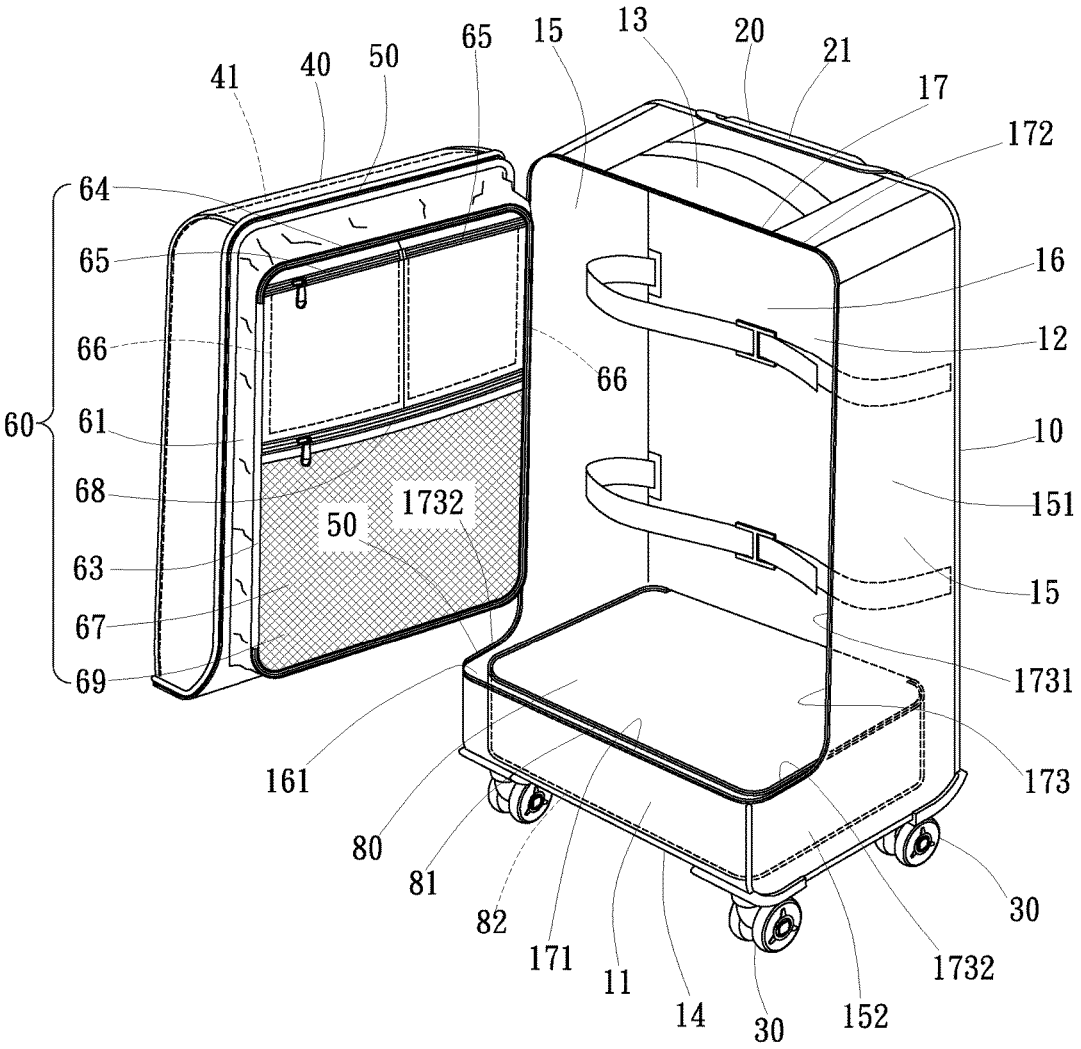
FIG. 1 is a schematic perspective view of a vertical luggage in an open status in accordance with the present invention.
Figure 2:
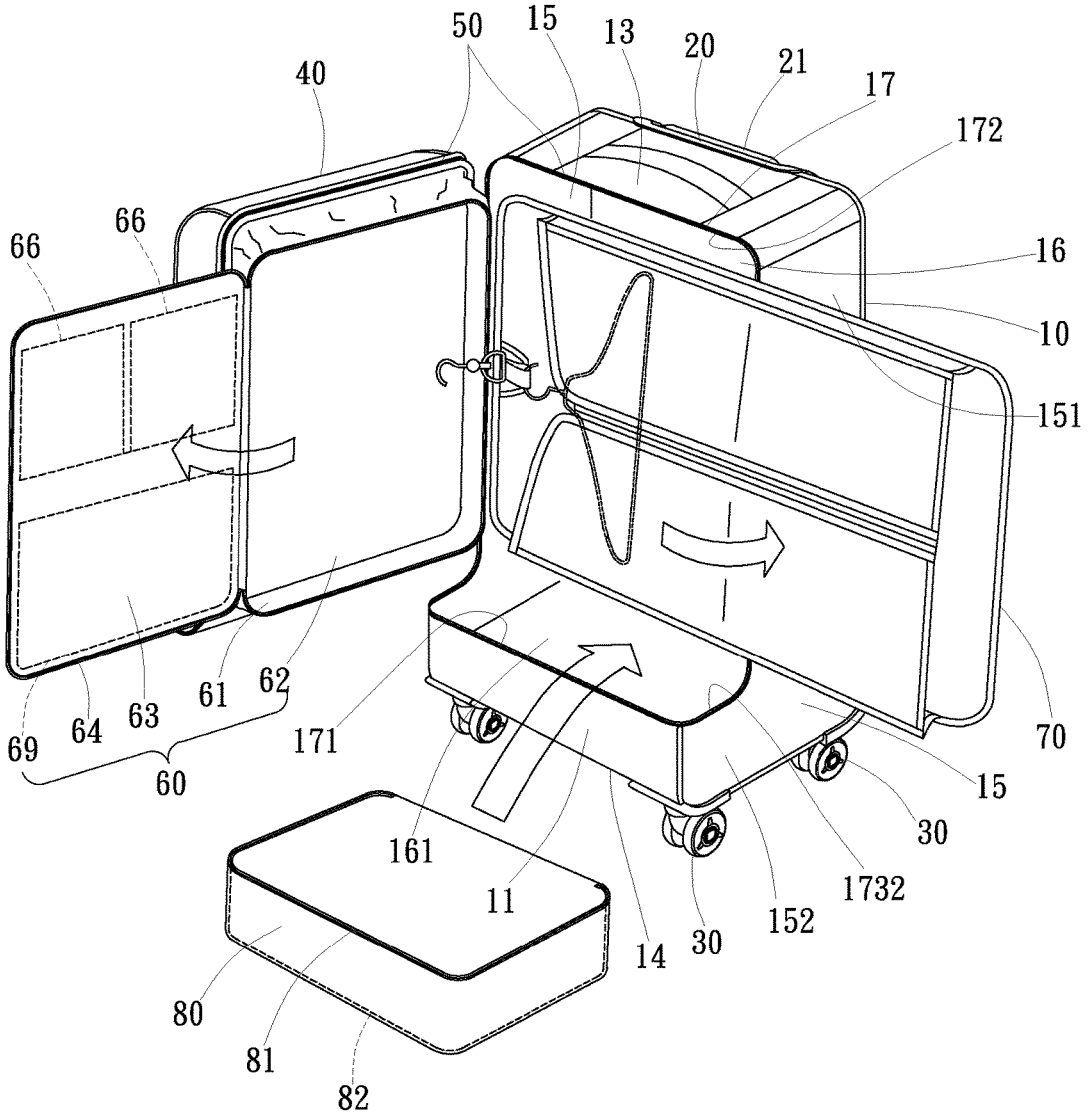
FIG. 2 illustrates the inner bag and the suit bag of the vertical luggage opened.

Referring to FIGS. 1 and 2, a vertical luggage in accordance with the present invention is shown. The vertical luggage comprises a luggage body 10. The luggage body 10 is a fabric luggage body that comprises a front panel 11, a back panel 12, a top panel 13, a bottom panel 14 and two opposing side panels 15 stitched together, defining therein a first accommodation chamber 16. The luggage further comprises a retractable handle unit 20 mounted in the top panel 13 adjacent to the back panel 12 and embedded in a hidden layer inside the luggage body 10 with a retractable handle 21 thereof extendable out of the top panel 13 for pulling by the user to drag the luggage body 10, and at least two, for example, four roller assemblies 30 mounted to a bottom side of the bottom panel 14 for enabling relatively easy rolling movement of the luggage body 10.

More particularly, the front panel 11 of the luggage body 10 comprises an opening 17 recessed in direction toward the back panel 12 and disposed in communication with the first accommodation chamber 16 in the luggage body 10. Due to the configuration of the opening 17, the luggage body 10 is formed as a rectangular box with a notched structure at the front side. More specifically, the opening 17 defines a front opening edge 171 that is horizontally located on the front panel 11, a top opening edge 172 that is horizontally located on the top panel 13, and two L-shaped side opening edges 173 respectively located on the side panels 15. Each L-shaped side opening edge 173 has a top end of a vertical portion 1731 thereof connected to the top opening edge 172, and a front end of a horizontal portion 1732 thereof connected to the front opening edge 171, thus, the aforesaid notched structure is presented.

Figure 5:
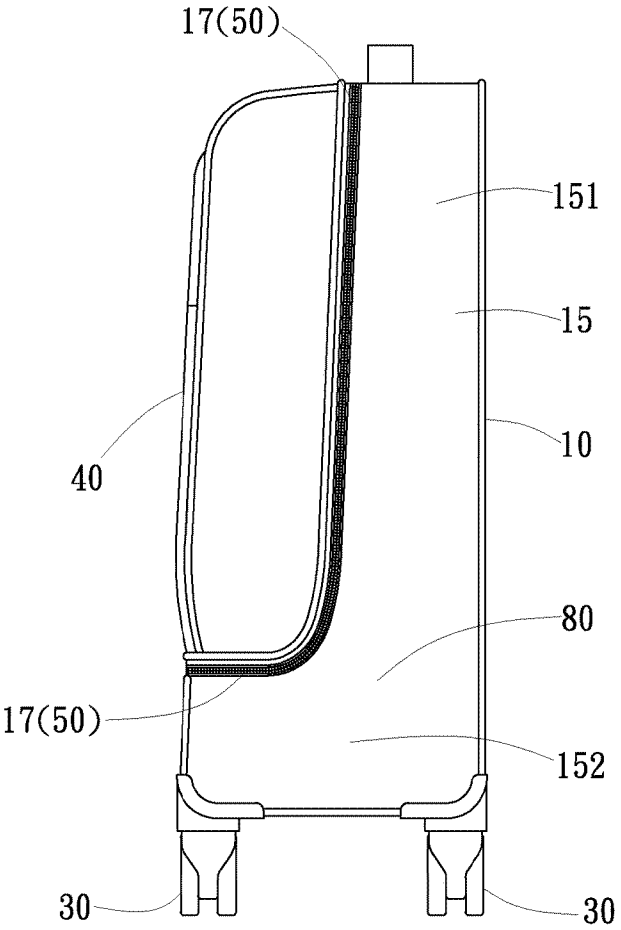
FIG. 5 is a schematic right side view of the vertical luggage in accordance with the present invention.

The vertical luggage further comprises a front bag 40 that is a fabric bag made by stitching and defining therein a second accommodation chamber 41. Further, the front bag 40 works as a cover for covering the front panel opening 17 of the luggage body 10. The front bag 40 has one side thereof fixedly connected (stitched) to the vertical portion 1731 of one L-shaped side opening edge 173 of the opening 17 so that the front bag 40 is horizontally turnable in one side to cover the opening 17, thereby forming with the luggage body 10 a complete rectangular bag (see FIGS. 3-5). The vertical luggage further comprises a first zipper 50 adapted for binding the other three sides of the front bag 40 to the front opening edge 171, the top opening edge 172 and the other L-shaped side opening edge 173 of the opening 17.

Through the structural design of the opening 17 of the luggage body 10 and the arrangement of the front bag 40 at the front panel 11 to fork as a cover, the first accommodation chamber 16 in the luggage body 10 will not be fully opened when the front bag 40 is opened horizontally, i.e., the lower part of the first accommodation chamber 16 is still shield by the front panel 11 when the front bag 40 is opened. Therefore, the user can open the front bag 40 to access to the first accommodation chamber 16 while keeping the vertical luggage in vertical, i.e., the user can directly open the front bag 40 without putting the luggage body 10 in horizontal. Achieving the effect of easy access to storage items.

Referring to FIGS. 1 and 2 again, a rectangular inner bag 60 is stitched to an inner side of the front bag 40. The inner bag 60 comprises a rectangular fabric peripheral wall 61 stitched to the inner side of the front bag 40, a rectangular third accommodation chamber 62 defined within the fabric peripheral wall 61, an inner cover panel 63 made of fabric in a rectangular shape with one edge thereof stitched to one side of the rectangular fabric peripheral wall 61 for closing the third accommodation chamber 62, and a second zipper 64 adapted for binding the other three sides of the inner cover panel 63 and the other three sides of the fabric peripheral wall 61 so that the user can open or close the third accommodation chamber 62 through the second zipper 64.

Figure 6:
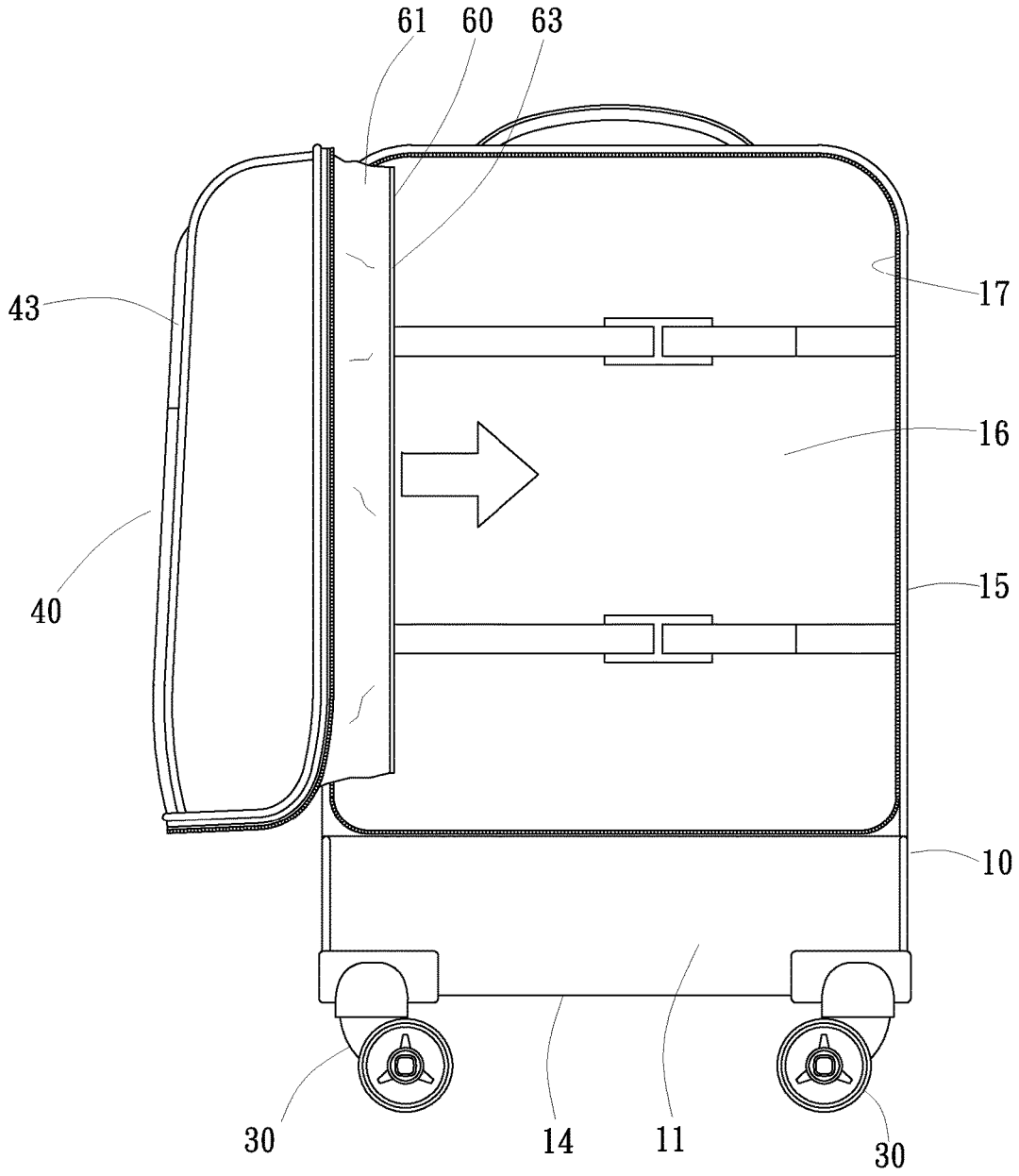
FIG. 6 is a schematic drawing of the present invention, illustrating the inner bag expanded.
Figure 7:
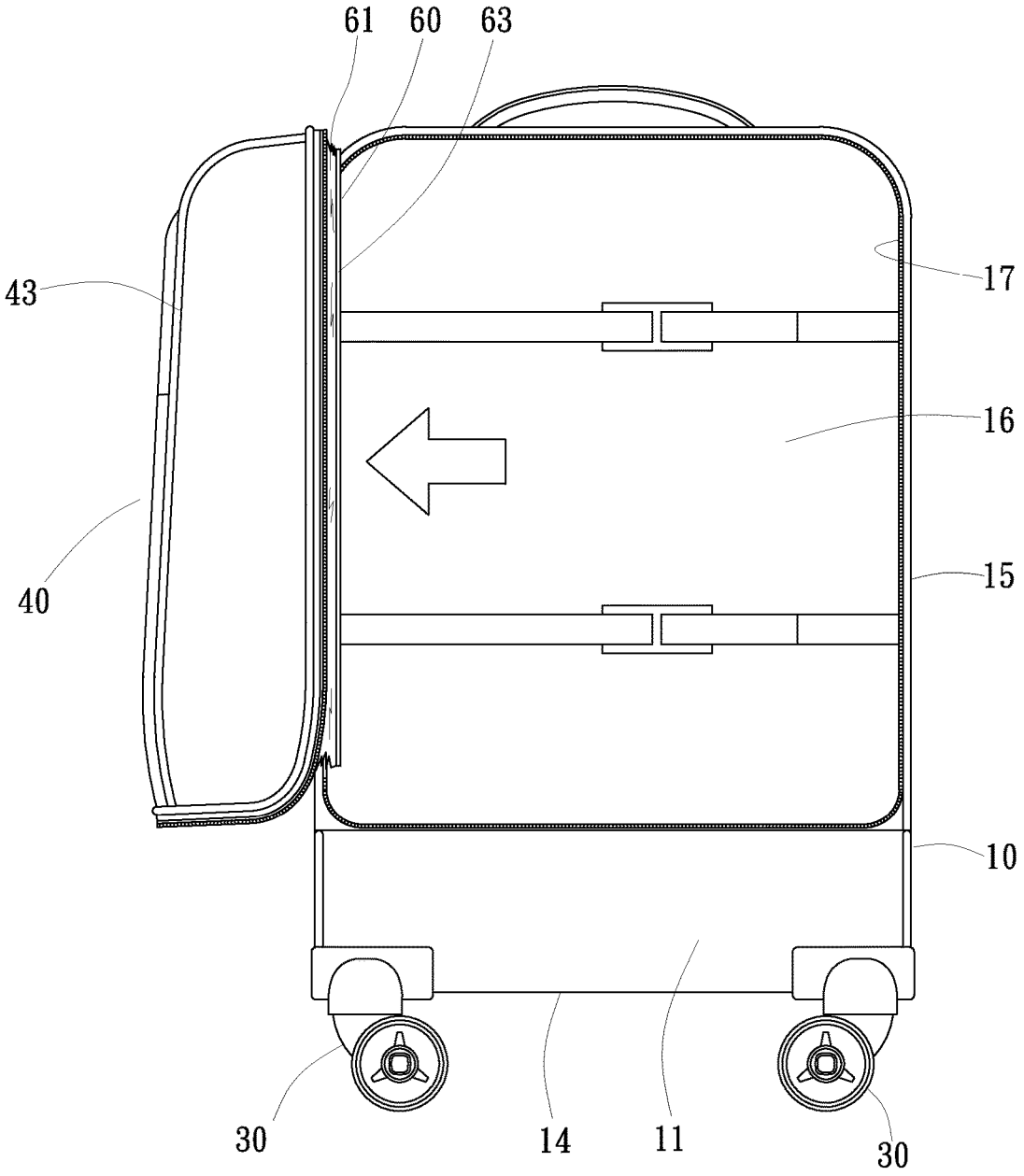
FIG. 7 is a schematic drawing of the present invention, illustrating the inner bag collapsed.

Referring to FIG. 2 again, a foldable suit bag 70 can be stitched to the fabric peripheral wall 61 of the inner bag 60 or an inner wall of the third accommodation chamber 62 so that the suit bag 70 can be horizontally extended, or folded up and received in the third accommodation chamber 62 inside the inner bag 60. When received in the third accommodation chamber 62, the suit bag 70 can be covered by the inner cover panel 63. Thus, the user can carry a suit conveniently when traveling. If a suit is received in the suit bag 70, the suit with the suit bag 70 can be folded up and received in the third accommodation chamber 62. At this time, the fabric peripheral wall 61 will expand (see FIG. 6). On the contrary, if the suit bag 70 is empty, the fabric peripheral wall 61 can be collapsed and flattened (see FIG. 7). Therefore, with the design of the inner bag 60, the present invention can make the space in the vertical luggage more flexible.

Figure 3:
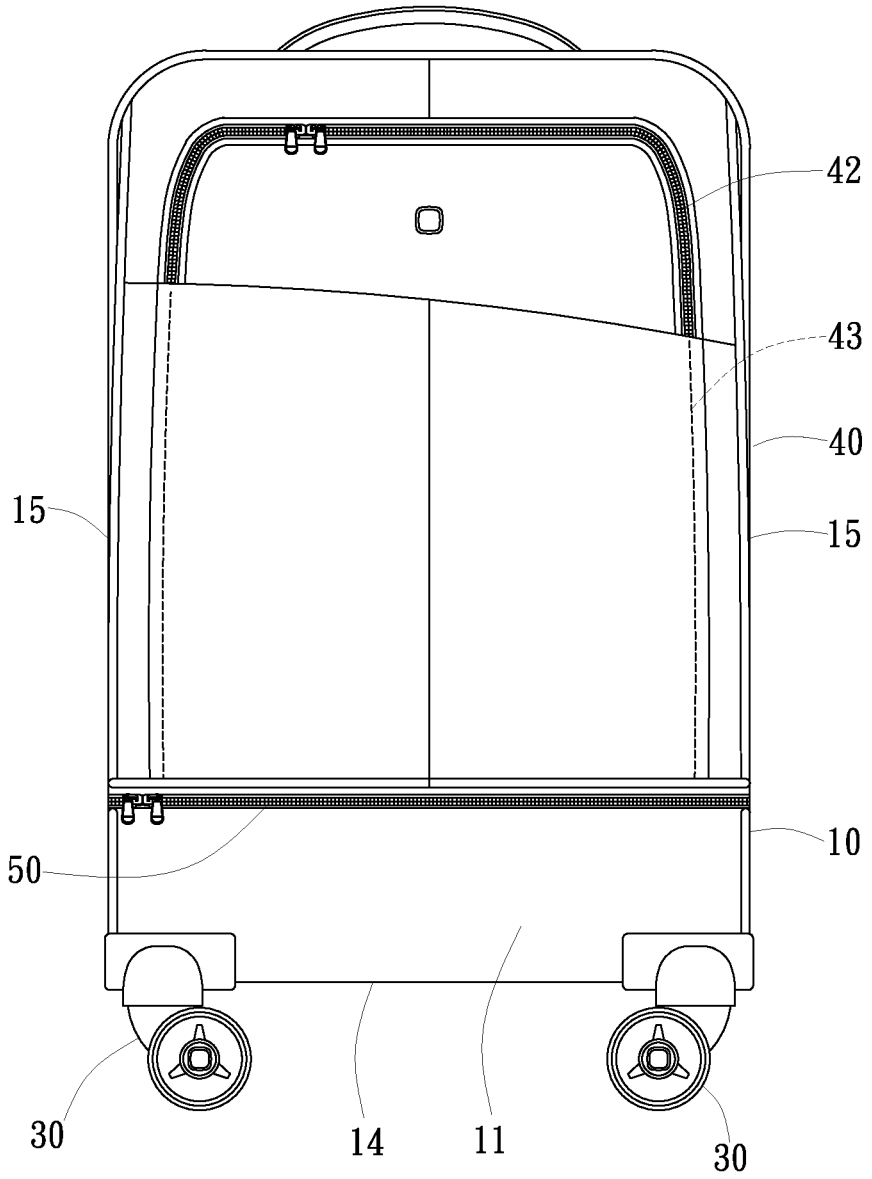
FIG. 3 is a schematic front side view of the vertical luggage in accordance with the present invention.
Figure 4:
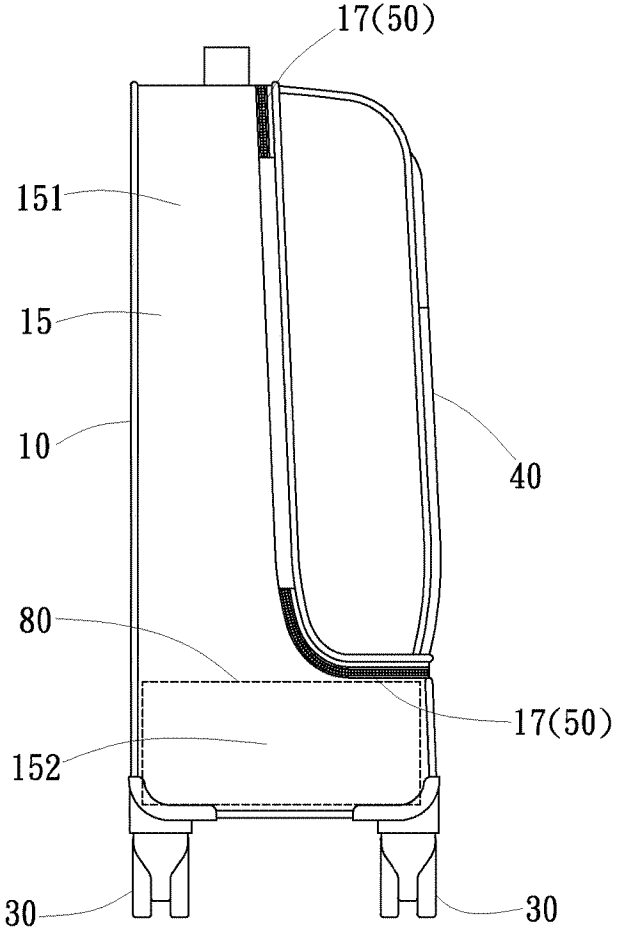
FIG. 4 is a schematic left side view of the vertical luggage in accordance with the present invention.

In order to facilitate storing small items, as illustrated in FIG. 3, the front bag 40 is configured to provide a front zipper opening 42 at a front side thereof. The front zipper opening 42 is disposed in communication with a first mezzanine space 43 in the front bag 40. As illustrated in FIG. 1 and FIG. 2, two inner zipper openings 65 are horizontally arranged in parallel on an opposing outer side of the inner cover panel 63. Each inner zipper opening 65 is disposed in communication with one respective second mezzanine space 66 in the inner cover panel 63. Further, a net bag 67 is mounted on the outer side of the inner cover panel 63 below the second mezzanine spaces 66, having a net bag zipper opening 68 provided at a top side thereof. The net bag zipper opening 68 is disposed in communication with a third mezzanine space 69 that is defined between the inner cover panel 63 and the net bag 67. Thus, the user can easily access to the first mezzanine space 43, each second mezzanine space 66 or the third mezzanine space 69 to store small items or to take small storage items without needing to put the vertical luggage in horizontal.

In order to prevent storage items from falling out of the first accommodation chamber 16 of the luggage body 10 while the vertical luggage stands still, as illustrated in FIG. 1, the front panel 11 of the luggage body 10 is made in the form of a rectangular sheet, each side panel 15 of the luggage body 10 is made in the form of a L-shaped sheet having a vertical portion 151 and a horizontal portion 152. The two opposite lateral sides of the front panel 11 are respectively stitched to the horizontal portions 152 of the side panels 15. The bottom side of the front panel 11 and the bottom side of the horizontal portion 152 of each side panel 15 are stitched to the peripheral edge of the bottom panel 14. Thus, a bottom layer space 161 is defined in the first accommodation chamber 16 and surrounded by the front panel 11, the horizontal portions 152 of the side panels 15, the bottom panel 14 and the back panel 12 for storing things. When the user opens the front bag 40 while keeping the vertical luggage in vertical, the storage items will not fall out of the bottom layer space 161.

Referring to FIGS. 1 and 2 again, a storage box 80 can be arranged in the bottom layer space 161. The storage box 80 can be a fabric box, having a fourth accommodation chamber 82 defined therein and a zipper opening 81 disposed at a top side therein in communication with the fourth accommodation chamber 82. After installation of the storage box 80 in the bottom layer space 161, it is surrounded by the front panel 11, the horizontal portions 152 of the side panels 15, the bottom panel 14 and the back panel 12. Preferably, two storage boxes 80 are arranged in the bottom layer space 161 with one storage box 80 fixedly stitched to the inside of the bottom layer space 161 and the other storage box 80 detachably mounted in the bottom layer space 161.

What is claimed is:

1. A vertical luggage, comprising:

a luggage body made of fabric in a rectangular shape and defining therein a first accommodation chamber, said fabric luggage body comprising a front panel, a back panel, a top panel, a bottom panel, and two side panels each connected to the front panel, the back panel, the top panel and the bottom panel, said front panel comprising an opening recessed toward said back panel and disposed in communication with said first accommodation chamber, said opening defining a front opening edge that is horizontally located on said front panel, a top opening edge that is horizontally located on said top panel and two L-shaped side opening edges respectively located on said side panels, each said L-shaped side opening edge having a top end of a vertical portion thereof connected to said top opening edge and a front end of a horizontal portion thereof connected to said front opening edge;

a retractable handle unit mounted in said top panel and embedded in said luggage body;

a plurality of roller assemblies mounted to a bottom side of said bottom panel a rectangular front bag made of fabric and defining therein a second accommodation chamber, said rectangular front bag having one side thereof fixedly connected to the said vertical portion of one said L-shaped side opening edge of said opening for covering said opening so that said front bag is horizontally turnable relative to said luggage body;

a first zipper adapted for binding the other three sides of said front bag to said front opening edge, said top opening edge and the other said L-shaped side opening edge of said opening; and a rectangular inner bag stitched to an inner side of said rectangular front bag, said rectangular inner bag comprising a rectangular fabric peripheral wall stitched to said inner side of said rectangular front bag, a third accommodation chamber defined within said fabric peripheral wall, a rectangular inner cover panel with one side stitched to one side of said rectangular fabric peripheral wall for covering said third accommodation chamber, and a second zipper adapted for binding three other sides of said rectangular inner cover panel and three other sides of said rectangular fabric peripheral wall.

2. The vertical luggage as claimed in claim 1, further comprising a suit bag stitched to one side of said inner bag and foldable and extendable horizontally, said suit bag being covered by said rectangular inner cover panel when folded up and received in said inner bag.

3. The vertical luggage as claimed in claim 1, wherein said rectangular front bag further comprises a first mezzanine space defined therein, and a front zipper opening located on a front side thereof in communication with said first mezzanine space.

4. The vertical luggage as claimed in claim 3, wherein said rectangular front bag further comprises two second mezzanine spaces arranged in parallel in said rectangular inner cover panel, and two inner zipper openings horizontally arranged in parallel on an opposing outer side of said rectangular inner cover panel and respectively disposed in communication with one respective said second mezzanine space.

5. The vertical luggage as claimed in claim 4, wherein said rectangular front bag further comprises a net bag mounted on the said outer side of said rectangular inner cover panel below said second mezzanine spaces, and a third mezzanine space defined between said rectangular inner cover panel and said net bag, said net bag comprising a net bag zipper opening disposed at a top side thereof in communication with said third mezzanine space.

6. The vertical luggage as claimed in claim 1, wherein each said side panel of said luggage body is made in the form of an L-shaped sheet comprising a vertical portion and a horizontal portion; said front panel of said luggage body is a rectangular sheet having two opposite lateral sides thereof respectively stitched to the horizontal portions of said two side panels of said luggage body, a bottom side of said front panel of said luggage body and a bottom side of said horizontal portion of each said side panel of said luggage body being stitched to a peripheral edge of said bottom panel of said luggage body so that a bottom layer space is defined in said first accommodation chamber and surrounded by said front panel, said horizontal portions of said side panels, said bottom panel and said back panel of said luggage body.

7. The vertical luggage as claimed in claim 6, further comprising a storage box, said storage box comprising a fourth accommodation chamber defined therein and a zipper opening in communication with said fourth accommodation chamber, said storage box being mounted in said bottom layer space and surrounded by said front panel, said horizontal portions of said side panels, said bottom panel and said back panel of said luggage body.

8. The vertical luggage as claimed in claim 7, wherein said storage box is fixedly stitched to an inner side of said bottom layer space.

9. The vertical luggage as claimed in claim 7, wherein said storage box is detachably mounted in said bottom layer space.

* * * * *